US009057996B2

(12) United States Patent
Tanaka et al.

(10) Patent No.: US 9,057,996 B2
(45) Date of Patent: Jun. 16, 2015

(54) IMAGE FORMING DEVICE AND METHOD FOR CONTROLLING A POWER SUPPLY FOR TRANSFER

(75) Inventors: Takafumi Tanaka, Toyokawa (JP); Takashi Watanabe, Toyokawa (JP)

(73) Assignee: KONICA MINOLTA BUSINESS TECHNOLOGIES, INC., Chiyoda-Ku, Tokyo (JP)

( * ) Notice: Subject to any disclaimer, the term of this patent is extended or adjusted under 35 U.S.C. 154(b) by 1038 days.

(21) Appl. No.: 13/089,895

(22) Filed: Apr. 19, 2011

(65) Prior Publication Data

US 2011/0262164 A1 Oct. 27, 2011

(30) Foreign Application Priority Data

Apr. 23, 2010 (JP) ..... 2010-099975

(51) Int. Cl.
*G03G 15/16* (2006.01)
*G03G 15/00* (2006.01)

(52) U.S. Cl.
CPC ..... *G03G 15/5004* (2013.01); *G03G 15/1675* (2013.01); *G03G 2215/00409* (2013.01); *G03G 2215/00599* (2013.01); *G03G 2215/00603* (2013.01); *G03G 2215/1614* (2013.01)

(58) Field of Classification Search
CPC ..... G03G 15/1675; G03G 15/5004; G03G 2215/1614; G03G 2215/00599; G03G 2215/00603; G03G 2215/00409
USPC ..... 399/66, 88, 297, 314, 317
See application file for complete search history.

(56) References Cited

U.S. PATENT DOCUMENTS

| | | | | |
|---|---|---|---|---|
| 6,219,498 | B1 * | 4/2001 | Katoh et al. | 399/45 |
| 2004/0028437 | A1 | 2/2004 | Yoshizuka | |
| 2004/0165901 | A1 | 8/2004 | Nakata et al. | |
| 2011/0058842 | A1 * | 3/2011 | Kim | 399/88 |

FOREIGN PATENT DOCUMENTS

| | | | |
|---|---|---|---|
| JP | 62-135864 | A | 6/1987 |
| JP | 03-231767 | A | 10/1991 |
| JP | 08-220901 | A | 8/1996 |
| JP | 2000-250326 | A | 9/2000 |
| JP | 2002-072715 | A | 3/2002 |
| JP | 2003-223022 | A | 8/2003 |

(Continued)

OTHER PUBLICATIONS

Office Action (Notification of Reasons of Rejection) dated Feb. 28, 2012, issued in corresponding Japanese Patent Application No. 2010-099975, and an English Translation thereof. (8 pages).

*Primary Examiner* — Ryan Walsh
(74) *Attorney, Agent, or Firm* — Buchanan Ingersoll & Rooney PC

(57) ABSTRACT

An image forming device includes a power supply for transfer for applying a voltage for transfer for transferring the toner image on the image carrier onto the recording paper sheet to the transfer member, and a recording paper sheet feed device for feeding the recording paper sheet into the pressing nip, and the method for controlling a power supply for transfer. The power supply for transfer is turned on and the output voltage of the power supply for transfer is set to 0 V before the transfer member is pressed against the image carrier, and the output voltage of the power supply for transfer is switched from 0 V to a high voltage for transfer after the transfer member is pressed against the image carrier.

15 Claims, 3 Drawing Sheets

(56) References Cited

FOREIGN PATENT DOCUMENTS

| | | | |
|---|---|---|---|
| JP | 2004-021101 | A | 1/2004 |
| JP | 2004-258207 | A | 9/2004 |
| JP | 2005-085031 | A | 3/2005 |
| JP | 2006-071751 | A | 3/2006 |
| JP | 2006-208497 | A | 8/2006 |
| JP | 2006-259235 | A | 9/2006 |
| JP | 2010-048960 | A | 3/2010 |

* cited by examiner

IMAGE FORMING DEVICE AND METHOD FOR CONTROLLING A POWER SUPPLY FOR TRANSFER

CROSS-REFERENCE TO RELATED APPLICATION

This invention is based on Japanese patent application No. 2010-99975 filed in Japan on Apr. 23, 2010, the entire content of which is hereby incorporated by reference.

BACKGROUND OF THE INVENTION

1. Field of the Invention

The present invention relates to an image forming device such as a copying machine, a printer, a facsimile machine, a multifunctional machine having functions of two or more of these and the like, and further to a method for controlling a power supply for transfer for transferring a toner image in such an image forming device onto a recording sheet such as a recording paper sheet.

2. Description of Related Art

Today, various types of image forming devices are known. Among them, there are such image forming devices which can form a toner image on an image carrier whose surface moves, and transfer the toner image onto a recording paper sheet, a recording sheet for an overhead projector or the like (hereinafter these may be collectively referred to as "recording paper sheet" or simply "paper sheet") by a rotatable transfer member which is pressed against the image carrier and to which a high voltage for transfer is applied from a power supply for transfer, the recording paper sheet being fed into a pressing nip between the image carrier and the transfer member.

Herein, common examples of the image carrier on which the toner image is formed and from which the toner image is to be transferred onto the recording paper sheet by the transfer member, are electrostatic latent image carriers such as a photosensitive member in electrophotographic monochrome image forming device.

In addition, for example, in an image forming device which comprises a plurality of electrophotographic image forming units which can form an electrostatic latent image on an electrostatic latent image carrier and develop the electrostatic latent image to form a toner image (including when a part of each image forming unit is shared by a plurality of the image forming units), in which the toner images formed in the image forming units are primarily transferred onto an intermediate transfer member such as an intermediate transfer belt, and the toner images on the intermediate transfer member are secondarily transferred onto a recording paper sheet by a secondary transfer member, the intermediate transfer member corresponds to the above-mentioned "the image carrier from which the toner image is to be transferred onto the recording paper sheet by the transfer member", and the secondary transfer member corresponds to the transfer member.

In either case, in an image forming device which can form a toner image on an image carrier whose surface moves, and transfer the toner image onto a recording paper sheet by a rotatable transfer member which is pressed against the image carrier and to which a high voltage for transfer is applied from a power supply for transfer, the recording paper sheet being fed into a pressing nip between the image carrier and the transfer member, in general, the recording paper sheet is fed from a recording paper sheet feed part; paused by a timing roller unit; and fed into the pressing nip between the image carrier and the transfer member by the timing roller unit at a timing when the toner image on the image carrier which reaches the pressing nip can be transferred onto the recording paper sheet.

As for the transfer member, if it is pressed against the image carrier at all times, it may be deformed due to creep deformation or other causes when the image forming device is not used for a long period of time or in other situations, and the deformation may lead to deteriorated image formation. Therefore, in some cases, the transfer member employed is provided to be capable of coming into contact with and retreating from the image carrier by a contact-retreat drive unit, and is pressed against the image carrier from the state of being away from the image carrier by an instruction of a controller of the contact-retreat drive unit, prior to the initiation of transfer of the toner image onto the recording paper sheet by the transfer member.

In some cases, the power supply for transfer is such a power supply which is turned on by a power supply ON instruction signal from a power supply controller, being turned off by a power supply OFF instruction signal, and which uses the voltage set by an output voltage setting signal from the power supply controller as an output voltage when the power supply is on so that a high voltage for transfer applied to the transfer member can be selected from a wide range from the minus side to the plus side. In this case, the power supply ON instruction signal from the power supply controller is also referred to as "remote signal", and the power supply is turned on by the remote signal ON.

An example of such a power supply for transfer include a power supply comprising a first high voltage generating part which generates a voltage of a first polarity (for example, negative polarity) and a second high voltage generating part which generates a voltage of a second polarity (for example, positive polarity) which is different from the first polarity, and which is turned on by a power supply ON instruction signal from a power supply controller, being turned off by a power supply OFF instruction signal from the power supply controller, and which uses the voltage set by an output voltage setting signal from the power supply controller as an output voltage when the power supply is on.

In the image forming device in which the transfer member which is capable of pressing against, coming into contact with and retreating from the image carrier by the contact-retreat drive unit is employed, in pressing the transfer member for transferring the toner image on the image carrier onto the recording paper sheet against the image carrier, when the transfer member is pressed against the image carrier in a state that a high voltage for transfer is applied to the transfer member, unallowable discharge may occur between the transfer member and the image carrier, leading to the phenomenon known as memory causing an image noise on the image carrier.

Accordingly, in general, when there is a request for image formation, the transfer member is pressed against the image carrier first, and then the high voltage for transfer is applied to the transfer member.

When a power supply employed is the above-mentioned power supply, i.e., a power supply such that is turned on and off by the remote signals ON and OFF, and that uses the voltage set by the output voltage setting signal as an output voltage when it is on, the transfer member is pressed against the image carrier, and then the output voltage is set to the high voltage for transfer by the output voltage setting signal with the remote signal ON.

Meanwhile, JP2006-208497A describes that a toner image is secondarily transferred onto the recording paper sheet by a secondary transfer roller, which is the transfer member, from an intermediate transfer belt, which is an image carrier holding the toner image to be transferred onto the recording paper sheet.

In addition, the document describes that after the secondary transfer roller is pressed against the intermediate transfer belt, an entrance voltage lower than a defined high voltage for transfer by a predetermined value is applied to the secondary transfer roller from the time when the front end of the recording paper sheet enters into the pressing nip between the roller and the belt until a predetermined period elapses, and the defined high voltage for transfer is then applied so that the voltage fluctuation of the secondary transfer roller at the entrance of the paper sheet is suppressed and images can be successfully transferred onto the front end portion of the paper sheet.

However, in an image forming device comprising an image carrier which is a rotatable image carrier, is capable of forming a toner image on a circumferential surface thereof and is capable of rotating while holding the toner image thereon, a transfer member which is for transferring the toner image on the image carrier onto a recording paper sheet and capable of rotating, provided in a manner capable of pressing against, coming into contact with and retreating from the image carrier, and which forms a pressing nip by being pressed against the image carrier, a power supply for transfer for applying a voltage to the transfer member for transfer for transferring the toner image on the image carrier onto the recording paper sheet, and a recording paper sheet feed device for feeding the recording paper sheet into the pressing nip, the power supply for transfer being turned on by a power supply ON instruction signal, being turned off by a power supply OFF instruction signal, and using a voltage set by an output voltage setting signal as an output voltage when it is on, after the transfer member is pressed against the image carrier, when the output voltage is set to a high voltage for transfer by the output voltage setting signal upon turning on the power supply by the power supply ON instruction signal, the rise of the output voltage of the power supply to the high voltage for transfer may be delayed.

As a result, if the distance from the front end of the recording paper sheet which is being paused normally by the timing roller unit to the pressing nip between the image carrier and the transfer member is set shorter to achieve size reduction and compactness of the image forming device and for other reasons, the rise of the high voltage for transfer is delayed with respect to the entrance of the recording paper sheet into the pressing nip, and considerable transfer failure may occur at an early stage of the transfer of the toner image onto the recording paper sheet.

The JP2006-208497A does not refer to this matter.

SUMMARY OF THE INVENTION

A first object of the present invention is to provide an image forming device comprising an image carrier which is rotatable, capable of forming a toner image on a circumferential surface thereof, and is capable of rotating while holding the toner image thereon, a transfer member which is for transferring the toner image on the image carrier onto a recording paper sheet and capable of rotating, provided in a manner capable of pressing against, coming into contact with and retreating from the image carrier, and which forms a pressing nip by being pressed against the image carrier, a power supply for transfer for applying a voltage to the transfer member for transfer for transferring the toner image on the image carrier onto the recording paper sheet, and a recording paper sheet feed device for feeding the recording paper sheet into the pressing nip, the power supply for transfer being turned on by a power supply ON instruction signal, being turned off by a power supply OFF instruction signal, and using a voltage set by an output voltage setting signal as an output voltage when it is on, the image forming device being free of the risk of unallowable discharge by a high voltage for transfer applied from the power supply for transfer to the transfer member for transferring the toner image onto the recording paper sheet by the transfer member and a delay in the rise of the high voltage for transfer, and being successfully capable of transferring the toner image on the image carrier onto the recording paper sheet.

A second object of the present invention is to provide a method for controlling a power supply for transfer in an image forming device comprising an image carrier which is rotatable, capable of forming a toner image on a circumferential surface thereof, and is capable of rotating while holding the toner image thereon, a transfer member which is for transferring the toner image on the image carrier onto a recording paper sheet and capable of rotating, provided in a manner capable of pressing against, coming into contact with and retreating from the image carrier, and which forms a pressing nip by being pressed against the image carrier, the power supply for transfer which is for applying a voltage to the transfer member for transfer for transferring the toner image on the image carrier onto the recording paper sheet, and a recording paper sheet feed device for feeding the recording paper sheet into the pressing nip, the power supply for transfer being turned on by a power supply ON instruction signal, being turned off by a power supply OFF instruction signal, and using a voltage set by an output voltage setting signal as an output voltage when it is on, the method being free of the risk of unallowable discharge by a high voltage for transfer applied from the power supply for transfer to the transfer member for transferring the toner image onto the recording paper sheet by the transfer member and a delay in the rise of the high voltage for transfer, and being successfully capable of transferring the toner image on the image carrier onto the recording paper sheet.

In order to achieve the first object, the present invention provides an image forming device comprising:

an image carrier which is rotatable and capable of forming a toner image on a circumferential surface thereof, and is capable of rotating while holding the toner image thereon, a transfer member which is for transferring the toner image on the image carrier onto a recording paper sheet and capable of rotating, provided in a manner capable of pressing against, coming into contact with and retreating from the image carrier, and which forms a pressing nip by being pressed against the image carrier, a power supply for transfer for applying a voltage to the transfer member for transfer for transferring the toner image on the image carrier onto the recording paper sheet, and a recording paper sheet feed device for feeding the recording paper sheet into the pressing nip, and a power supply controller for the power supply for transfer, the power supply for transfer being turned on by a power supply ON instruction signal from the power supply controller, being turned off by a power supply OFF instruction signal from the power supply controller, and using a voltage set by an output voltage setting signal from the power supply controller as an output voltage when the power supply is on, the power supply controller turning on the power supply for transfer and setting the output voltage of the power supply for transfer to 0 V before the transfer member is pressed against the image carrier, and switching the output voltage of the power supply for transfer from 0 V to a high voltage for transfer after the transfer member is pressed against the image carrier.

In order to achieve the second object, the present invention provides a method for controlling a power supply for transfer in an image forming device, which comprises an image carrier which is rotatable and capable of forming a toner image on a circumferential surface thereof, and is capable of rotating while holding the toner image thereon, a transfer member which is for transferring the toner image on the image carrier onto a recording paper sheet and capable of rotating, provided in a manner capable of pressing against, coming into contact with and retreating from the image carrier, and which forms a pressing nip by being pressed against the image carrier, the power supply for transfer which is for applying a voltage to the transfer member for transfer for transferring the toner image on the image carrier onto the recording paper sheet, and a recording paper sheet feed device for feeding the recording paper sheet into the pressing nip, the power supply for transfer being turned on by a power supply ON instruction signal, being turned off by a power supply OFF instruction signal, and using a voltage set by an output voltage setting signal as an output voltage when it is on, the method comprising the steps of:

turning on the power supply for transfer and setting the output voltage of the power supply for transfer to 0 V before the transfer member is pressed against the image carrier, and switching the output voltage of the power supply for transfer from 0 V to a high voltage for transfer after the transfer member is pressed against the image carrier.

The foregoing and other objects, features, aspects and advantages of the present invention will become more apparent from the following detailed description of the preferred embodiments of the present invention when taken in conjunction with accompanying drawings.

DESCRIPTION OF THE PREFERRED. EMBODIMENTS

Figure 1:
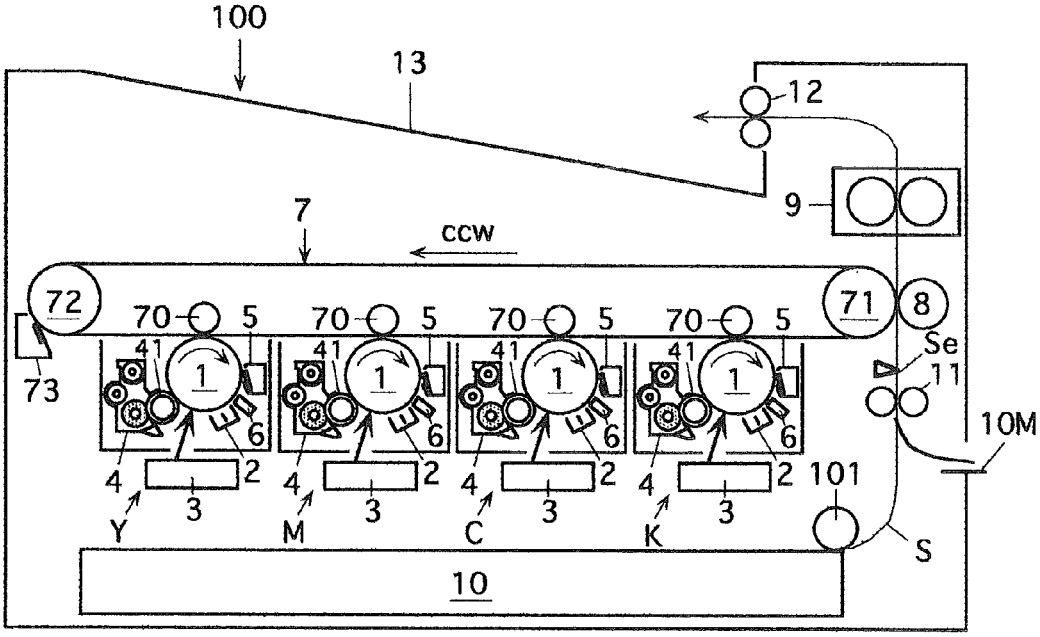
FIG. 1 shows a schematic construction of an example of the image forming device.

The image forming device and the method for controlling a power supply for transfer according to the embodiments of the present invention are basically as follows:

(1) Image Forming Device

An image forming device comprising:

an image carrier which is rotatable and capable of forming a toner image on a circumferential surface thereof, and is capable of rotating while holding the toner image thereon, a transfer member which is for transferring the toner image on the image carrier onto a recording paper sheet and capable of rotating, provided in a manner capable of pressing against, coming into contact with and retreating from the image carrier, and which forms a pressing nip by being pressed against the image carrier, a power supply for transfer for applying a voltage to the transfer member for transfer for transferring the toner image on the image carrier onto the recording paper sheet, and a recording paper sheet feed device for feeding the recording paper sheet into the pressing nip, and a power supply controller for the power supply for transfer, the power supply for transfer being turned on by a power supply ON instruction signal from the power supply controller, being turned off by a power supply OFF instruction signal from the power supply controller, and using a voltage set by an output voltage setting signal from the power supply controller as an output voltage when the power supply is on, the power supply controller turning on the power supply for transfer and setting the output voltage of the power supply for transfer to 0 V before the transfer member is pressed against the image carrier, and switching the output voltage of the power supply for transfer from 0 V to a high voltage for transfer after the transfer member is pressed against the image carrier.

(2) Method for Controlling a Power Supply for Transfer in an Image Forming Device A method for controlling a power supply for transfer in an image forming device, which comprises an image carrier which is rotatable and capable of forming a toner image on a circumferential surface thereof, and is capable of rotating while holding the toner image thereon, a transfer member which is for transferring the toner image on the image carrier onto a recording paper sheet and capable of rotating, provided in a manner capable of pressing against, coming into contact with and retreating from the image carrier, and which forms a pressing nip by being pressed against the image carrier, the power supply for transfer which is for applying a voltage to the transfer member for transfer for transferring the toner image on the image carrier onto the recording paper sheet, and a recording paper sheet feed device for feeding the recording paper sheet into the pressing nip, the power supply for transfer being turned on by a power supply ON instruction signal, being turned off by a power supply OFF instruction signal, and using a voltage set by an output voltage setting signal as an output voltage when it is on, the method comprising the steps of:

turning on the power supply for transfer and setting the output voltage of the power supply for transfer to 0 V before the transfer member is pressed against the image carrier, and switching the output voltage of the power supply for transfer from 0 V to a high voltage for transfer after the transfer member is pressed against the image carrier.

In these image forming device and method for controlling the power supply for transfer, the power supply for transfer is turned on and the output voltage of the power supply for transfer is set to 0 V before the transfer member is pressed against the image carrier, and the output voltage of the power supply for transfer is switched from 0 V described above to a high voltage for transfer after the transfer member is pressed against the image carrier.

Therefore, when the transfer member is pressed against the image carrier, the output of the power supply applied to the transfer member is 0 V, and thus there is no possibility of unallowable discharge.

Furthermore, after the transfer member is pressed against the image carrier, the output voltage of the power supply for transfer is switched from 0 V described above to a high voltage for transfer. At this time, since the power supply for transfer is already turned on by the power supply ON instruction signal (remote signal) from the power supply controller, the rise of the voltage from 0 V to the high voltage for transfer is quick, and there is no delay in the rise of the high voltage for transfer, which allows successful transfer of the toner image on the image carrier onto the recording paper sheet.

The power supply for transfer comprises, for example, a first high voltage generating part which generates a voltage of a first polarity and a second high voltage generating part which generates a high voltage of a second polarity which is different from the first polarity, and has the voltage set by the output voltage setting signal from the power supply controller as the output voltage.

When such a power supply for transfer is employed, for example, it is possible to mention the case in which the value of the output voltage of the first high voltage generating part is a fixed value; the value of the output voltage of the second high voltage generating part is variable; and the value of the output voltage of the second high voltage generating part is set by the output voltage setting signal from the power supply controller.

In addition, the case in which the first polarity is negative, while the second polarity is positive can be also mentioned.

In either case, the power supply controller may switch an output voltage of the power supply for transfer from 0 V described above to a high voltage for transfer before the recording paper sheet is fed into the pressing nip between the image carrier and the transfer member by the recording paper sheet feed device.

An example of the recording paper sheet feed device is such a recording paper sheet feed device comprising a recording paper sheet feed part, and a timing roller unit for pausing the recording paper sheet fed from the recording paper sheet feed part short of the pressing nip and feeding the recording paper sheet into the pressing nip at a timing when the toner image on the image carrier which reaches the pressing nip can be transferred onto the recording paper sheet.

An example of the image forming device is such an image forming device in which the distance from the position of the front end of the recording paper sheet which is paused by the timing roller unit to the pressing nip between the image carrier and the transfer member is shorter than a predetermined distance.

This "predetermined distance" means such a distance that in forming a toner image on the image carrier and transferring the toner image onto the recording paper sheet, if the power supply controller turns on the power supply for transfer and the output voltage of the power supply is set to the high voltage for transfer after the transfer member is pressed against the image carrier, the paused recording paper sheet starts to be fed into the pressing nip by the timing roller unit in a period of time shorter than that required for a voltage applied to the transfer member to rise to the set high voltage for transfer.

FIG. 1 shows an example of an image forming device. The image forming device in FIG. 1 is a so-called tandem-type color printer 100.

The printer 100 has a driving roller 71, a roller 72 opposing the driving roller 71 and an endless intermediate transfer belt 7 wound on these rollers. The intermediate transfer belt is an intermediate transfer member in this embodiment. The intermediate transfer belt 7 is rotated by the driving roller 71 driven by a belt drive (not shown) in the counterclockwise direction CCW in the FIG. 1 (direction of the arrow in FIG. 1).

A cleaning device 73 for cleaning toner or the like on the transfer belt 7 left from secondary transfer described later opposes a portion of the belt 71 supported by the roller 72, and a secondary transfer roller 8 opposes the driving roller 71 via the belt 7. The secondary transfer roller 8 is a transfer member for transferring a toner image on the transfer belt 7 onto a recording paper sheet in this Example.

The secondary transfer roller 8 is pressed against the belt 7, or is brought away from the belt 7 by a contact-retreat drive (a contact-retreat drive unit) 81. In transferring the toner image on the belt 7 onto the recording paper sheet, the secondary transfer roller 8 is pressed against the belt 7 from the state of being away from the belt 7 at a timing described later by the contact-retreat drive 81 (refer to FIG. 3). When the toner image is not transferred onto the recording paper sheet, the secondary transfer roller 8 is brought away from the belt 7.

The secondary transfer roller 8 forms a pressing nip N between itself and the intermediate transfer belt 7 when it is pressed against the intermediate transfer belt V. In this embodiment, the secondary transfer roller 8 is rotationally driven in response to the rotation of a timing roller unit 11 to feed the recording paper sheet. The timing roller unit 11 is driven to rotate by a transport drive part (not shown).

Figure 3:
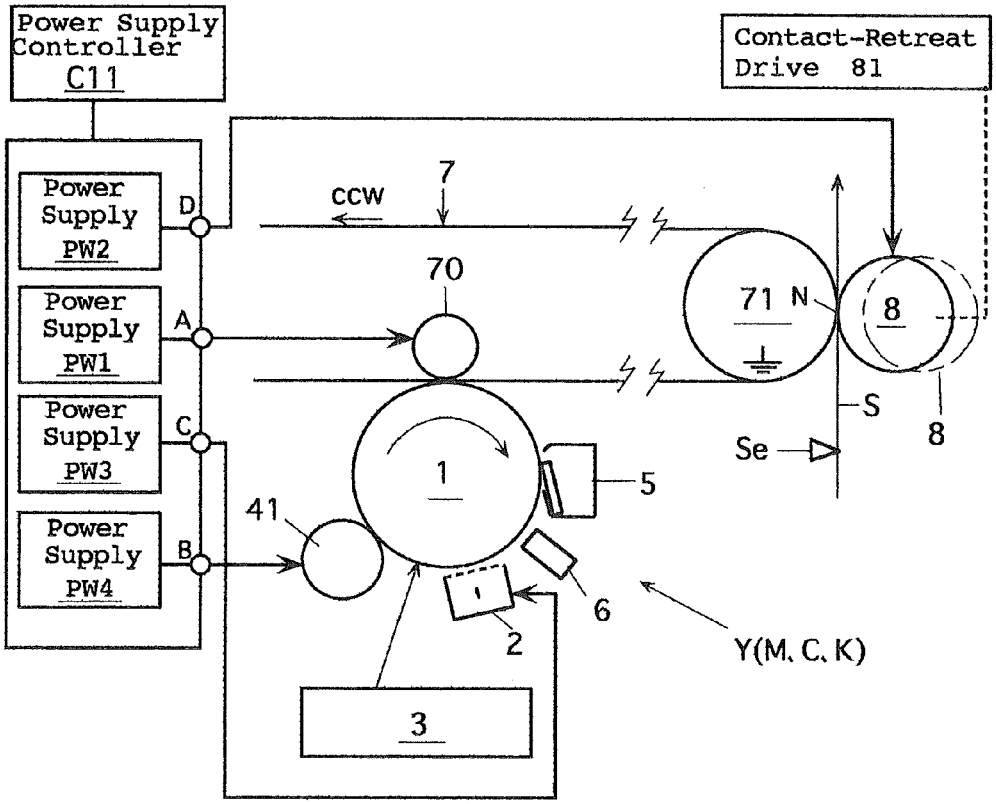
FIG. 3 schematically shows a power supply connection circuit for an image forming unit, a secondary transfer roller and other components.

Moreover, as shown in FIG. 3, a secondary transfer bias can be applied from a high voltage power supply PW2 for secondary transfer to the secondary transfer roller 8.

A fixing device 9 is disposed above the intermediate transfer belt 7 and the secondary transfer roller 8, and the timing roller unit 11 in the form of a pair of rollers are disposed below the intermediate transfer belt 7 and the secondary transfer roller 8. A recording paper sheet container cassette 10 for feeding a recording paper sheet S is further disposed below the timing roller unit 11. Moreover, a bypass tray 10M from which recording paper sheets can be fed by the user is also provided.

The fixing device 9 comprises a fixing heating roller including a heat source such as a halogen lamp heater and a pressure roller pressed against this fixing heating roller.

The recording paper sheet S contained in the recording paper sheet container cassette 10 can be withdrawn sheet by sheet by a paper sheet feed roller 101 to be fed to the timing roller unit 11. Alternatively, the recording paper sheet S can be fed from the bypass tray 10M.

Between the rollers 71, 72 on which the intermediate transfer belt 7 is wound, yellow image forming unit Y, magenta image forming unit M, cyan image forming unit C and black image forming unit K are disposed in the order stated from the roller 72 toward the roller 71 along the transfer belt 7.

The Y, M, C, K image forming units each comprises a drum type photosensitive member 1 as an electrostatic latent image carrier, a charger 2, an exposure device 3, a development device 4, and a cleaning device 5 are disposed around the photosensitive member 1 in the order stated.

A primary transfer roller 70 is disposed opposing the photosensitive member 1 of each image forming unit across the belt 7. The primary transfer roller 70 is pressed by a pressing unit (not shown) toward the photosensitive member 1, and is brought into contact with the belt 7 to be rotated in response to the movement of the belt. In addition, the primary transfer roller 70 can bring the belt 7 into contact with the photosensitive member 1.

As shown in FIG. 3, a primary transfer bias for primarily transferring a toner image formed on the photosensitive member 1 onto the belt 7 can be applied from a high voltage power supply PW1 for primary transfer to the primary transfer roller 70.

The exposure device 3 is capable of forming an electrostatic latent image by exposing the photosensitive member 1 by dot exposure with a flashing laser beam, depending on the image information provided from a scanner which may be connected to a personal computer, a facsimile machine, or a controller C1 described later (not shown).

The photosensitive member 1 in each image forming unit is a negatively charged photosensitive member herein, and can be rotationally driven in the clockwise direction in the FIG. 1 by a drive motor (not shown).

The charger 2 in each image forming unit is a scorotron charger in this example, and a voltage for charging the photosensitive member is applied from a high voltage power supply PW3 for charging at a predetermined timing, as shown in FIG. 3. The charger 2 may be such that uses charging roller and the like.

In this example, the development device 4 in each image forming unit can develop in reversal-development the electrostatic latent image formed on the photosensitive member 1 by using a one-component developer which is mainly composed of a toner by a rotatable member 41 for holding the developer (hereinafter referred to as "development roller".) (refer to FIG. 3) in the form of a roller to which a developing bias is applied from a high voltage power supply PW4 for development, as shown in FIG. 3.

Now, the high voltage power supply for secondary transfer PW2 which is a power supply for secondary transfer will be described.

Figure 4:
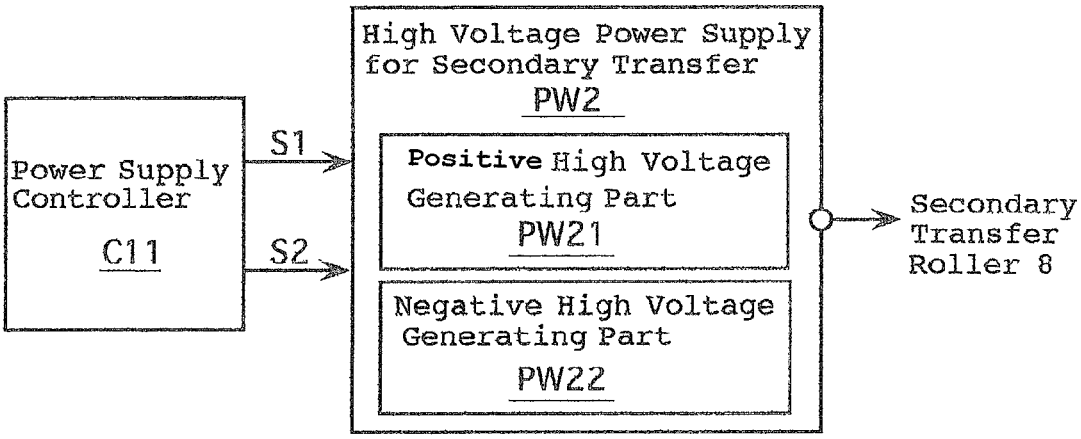
FIG. 4 is a block diagram which shows a construction of the power supply for transfer and its control circuit.

As shown in FIG. 4, the power supply PW2 is a power source which comprises a positive high voltage generating part PW21 and a negative high voltage generating part PW22, and is turned on by a power supply ON instruction signal (remote signal ON) from a power supply controller C11 included in an overall controller C1 described later, is turned off by a power supply OFF instruction signal (remote signal OFF) from the power supply controller C11, and uses an output voltage set by an output voltage setting signal from the power supply controller C11 when it is on.

The power supply PW2 herein can output a voltage ranging from −500 V to +4500 V. The positive high voltage generating part PW21 can generate a positive voltage ranging from 0 V to 5000 V, while a negative high voltage generating part PW22 can generate a constant negative voltage of −500 V. For example, when the power supply controller C11 sets a power supply output of +2000 V, the positive high voltage generating part PW21 generates a positive voltage of 2500 V. As a result, +2000 V is output.

Figure 2:
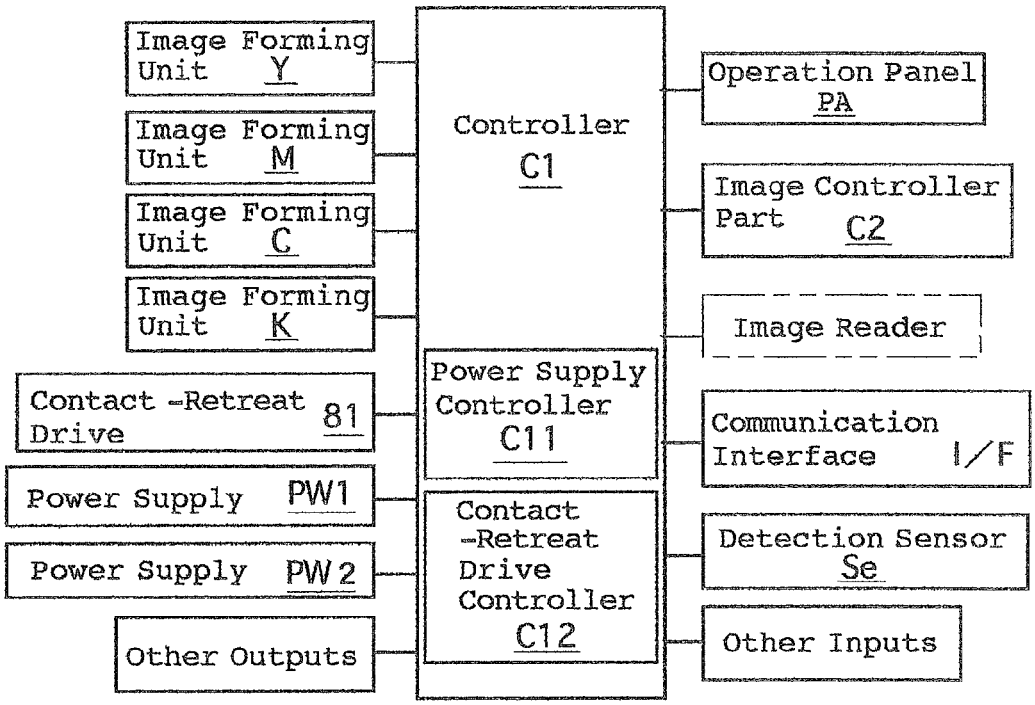
FIG. 2 is a block diagram which shows a control circuit of the image forming device in FIG. 1.

FIG. 2 shows a control circuit of the printer 100. This control circuit comprises the overall controller C1. To this overall controller C1 are connected not only (1) an operation panel PA, but also (2) an external computer, a communication interface I/F for communicating with an external facsimile machine or the like, (3) an image controller part C2 which requests the controller C1 to start image formation by performing necessary image processing depending on image information input via the communication interface I/F, or input from an image scanner which may be connected to the controller C1, and the like. On the operation panel PA are mounted a print key for manually instructing printing, a numeric keypad for setting the number of sheets for image formation, a display for indicating various information, and other components.

Furthermore, the image forming units Y, M, C, K, the contact-retreat drive 81 of the secondary transfer roller 8, among other components, are also connected to the overall controller C1. These are operated by the instruction of the controller C1 at a predetermined timing. A paper sheet detection sensor Se is positioned between the timing roller unit 11 and the secondary transfer roller 8. The sensor Se is for detecting the front end of the recording paper sheet S which has passed through the timing roller unit 11. The sensor Se as well as other sensors (not shown) are also connected to the controller C1.

The controller C1 also comprises the power supply controller C11 for controlling the turning on and off of the power and other operations such as the power supplies PW1 to PW4 shown in FIGS. 2 and 3, and also comprises the controller C12 of the contact-retreat drive 81, among other components. Parts of these power supply controller C11 and the contact-retreat drive controller C12 may be commonly used by parts for realizing other functions in the controller C1.

According to this printer, images can be formed by using one or more of the image forming units Y, M, C, K.

Taking as an example the case where all of the image forming units Y, M, C and K are used to form a full-color image, a yellow toner image is first formed in the yellow image forming unit Y, and this image is then primarily transferred onto the transfer belt 8.

That is, in the yellow image forming unit Y, the photosensitive member 1 is rotationally driven in the clockwise direction in the FIG. 1; the surface of the photosensitive member 4 is uniformly charged with a predetermined potential; the charged area is exposed with a light beam from the exposure device 3 to form an image corresponding to the yellow image; and the electrostatic latent image corresponding to the yellow image is formed on the photosensitive member 1.

This electrostatic latent image is developed by the development roller 41 to which a developing bias is applied from the high voltage power supply for development PW4 of the development device 4 having the yellow toner to become a visible yellow toner image. The yellow toner image is primarily transferred onto the intermediate transfer belt 7 by the primary transfer roller 70. At this time, a primary transfer bias is applied from the power supply PW1 to the primary transfer roller 70.

Likewise, a magenta toner image is formed in the magenta image forming unit M and is transferred onto the transfer belt 7; a cyan toner image is formed in the cyan image forming unit C and is transferred onto the transfer belt 7; and a black toner image is formed in the black image forming unit K and is transferred onto the transfer belt 7.

The yellow, magenta, cyan and black toner images are formed at a timing when these images are transferred and stacked onto the intermediate transfer belt 7.

The toner images stacked on the transfer belt 7 in such a manner moves toward the secondary transfer roller 8 by the rotation of the transfer belt 7.

Meanwhile, the recording paper sheet S is withdrawn sheet by sheet from the recording paper sheet container cassette 10 by the paper sheet feed roller 101, or fed from the bypass tray 10M to the timing roller unit 11, and detected by the paper sheet detection sensor Se immediately after it has passed the timing roller unit 11, whereby the recording paper sheet S is paused at the timing roller unit.

The recording paper sheet S which waits at the timing roller unit 11 in such a manner starts to be transported again by the timing roller unit 11 at a timing when there is a request for image formation from the image controller part C2 to the controller C1.

Figure 5:
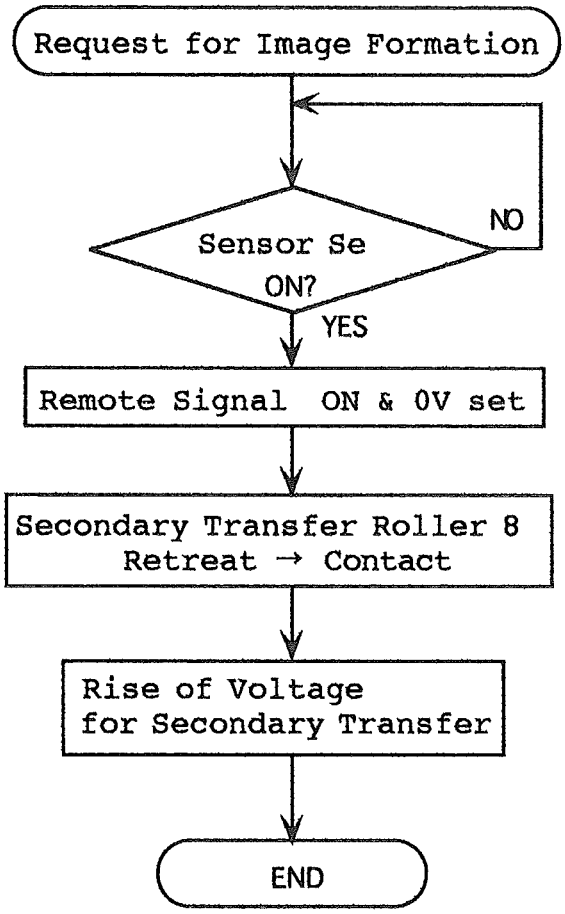
FIG. 5 is a flowchart which shows an example of control of the power supply for transfer by the controller shown in FIG. 3.

In addition, as shown in the flowchart of FIG. 5, the power supply for secondary transfer PW2 is turned on at a timing when there is a request for image formation from the image controller part C2 to the controller C1 by the remote signal ON from the controller C11 in the controller C1, and the output of the power supply PW2 is set to 0 V by output setting. The output is, for example, 8-bit resolution. Therefore, the output is actually not exactly 0 V and may be, for example, about 7 V. Even if the output is actually not exactly 0 V and is, for example, about 7 V, its degree can be regarded as 0 V in this embodiment.

Successively, by the instruction of the contact-retreat drive controller C12 in the controller C1 the contact-retreat drive 81 presses the secondary transfer roller 8 against the intermediate transfer belt 8, and forms the pressing nip N between itself and the belt 7. As mentioned, the power supply PW2 is turned on before the transfer roller 8 is pressed against the intermediate transfer belt 7. Since the power supply output is set to 0 V, there is no possibility of unallowable discharge while the roller 8 is pressed against the belt 7.

Thereafter, before the recording paper sheet transferred by the timing roller unit 11 enters into the pressing nip N, the output voltage of the power supply PW2 is switched from 0 V described above to a predetermined high voltage for transfer (herein, +2000 V).

At this time, since the power supply for transfer PW2 is turned on already by the power supply ON instruction signal (remote signal ON) from the power supply controller C11, the rise from 0 V to the high voltage for transfer is quick, and there is no delay in the rise of the high voltage for transfer with respect to the entrance of the recording paper sheet into the pressing nip N. Accordingly, the toner image on the belt 7 is successfully transferred onto the recording paper sheet S.

In this Example, the distance from the position of the front end of the recording paper sheet S paused by the timing roller unit 11 to the pressing nip N between the belt 7 and the secondary transfer roller 8 is such that, if, after the transfer roller 8 is pressed against the belt 7 at a timing when there is a request for image formation from the image controller part C2 to the controller C1, the power supply controller C11 turns on the power supply for transfer PW2 and sets the output voltage of the power supply to the high voltage for transfer (herein, +2000 V), due to a delay in the responsibility of the high voltage generating part PW21, −500 V is output for about 50 ms (50 milliseconds), and the voltage then rises to the transfer voltage +2000 V, and due to such a delay in this responsibility, the recording paper sheet S which has been on standby for a period of time shorter than that required for the voltage applied to the transfer roller 8 to rise to the set high voltage for transfer +2000 V starts to enter into the pressing nip N by the timing roller unit 11. In this embodiment, however, there is no such a delay in the rise of the high voltage for transfer, and the toner image on the belt 7 can be successfully transferred onto the recording paper sheet S accordingly.

The recording paper sheet on which a toner image is secondarily transferred in such a manner passes through the fixing device 9 so that the toner image is fixed by fusing, and is discharged into a discharge tray 13 by a discharge roller unit 12.

The toner and other matters on the photosensitive member 1 of the image forming unit left from the primary transfer are removed by the cleaning device 5, and residual charge is removed by an optical charge eraser 6 to prepare for the next image formation.

The toner and other matters on the transfer belt 7 left from the transfer are removed by the cleaning device 73.

Although the image forming device described with reference to FIG. 1 is the tandem-type full-color printer 100, but the present invention can be also applied to monochrome image forming devices. The present invention can be also applied to other types of multi-color image forming devices, for example, so-called four-cycle type color image forming devices and like cycle-type image forming devices.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method for controlling a power supply for transfer in an image forming device comprising:

an image carrier which is rotatable and capable of forming a toner image on a circumferential surface thereof, and is capable of rotating while holding the toner image thereon, a transfer member which is for transferring the toner image on the image carrier onto a recording paper sheet and capable of rotating, provided in a manner capable of pressing against, coming into contact with and retreating from the image carrier, and which forms a pressing nip by being pressed against the image carrier, the power supply for transfer which is for applying a voltage to the transfer member for transfer for transferring the toner image on the image carrier onto the recording paper sheet, and a recording paper sheet feed device for feeding the recording paper sheet into the pressing nip, the power supply for transfer being turned on by a power supply ON instruction signal, being turned off by a power supply OFF instruction signal, and using a voltage set by an output voltage setting signal as an output voltage when the power supply is on, the method comprising the steps of:

turning on the power supply for transfer and setting the output voltage of the power supply for transfer to effectively 0 V before the transfer member is pressed against the image carrier, and switching the output voltage of the power supply for transfer from effectively 0 V to a high voltage for transfer after the transfer member is pressed against the image carrier, wherein the power supply for transfer comprises a first high voltage generating part which generates a voltage of a first polarity and a second high voltage generating part which generates a high voltage of a second polarity which is different from the first polarity, and both the first high voltage generating part and the second high voltage generating part simultaneously generate the high voltage when the power supply controller turns on the power supply for transfer and sets the output voltage of the power supply for transfer to effectively 0 V.

2. The method for controlling the power supply for transfer in the image forming device according to claim 1, wherein a value of an output voltage of the first high voltage generating part is a fixed value; a value of an output voltage of the second high voltage generating part is variable; and the value of the output voltage of the second high voltage generating part is set by the output voltage setting signal.

3. The method for controlling the power supply for transfer in the image forming device according to claim 2, wherein the first polarity is negative, and the second polarity is positive.

4. The method for controlling the power supply for transfer in the image forming device according to claim 3, wherein the output voltage of the power supply for transfer is switched from said effectively 0 V to the high voltage for transfer before the recording paper sheet is fed into the pressing nip between the image carrier and the transfer member by the recording paper sheet feed device.

5. The method for controlling the power supply for transfer in the image forming device according to claim 2, wherein the output voltage of the power supply for transfer is switched from said effectively 0 V to the high voltage for transfer before the recording paper sheet is fed into the pressing nip between the image carrier and the transfer member by the recording paper sheet feed device.

6. The method for controlling the power supply for transfer in the image forming device according to claim 1, wherein the output voltage of the power supply for transfer is switched from said effectively 0 V to the high voltage for transfer before the recording paper sheet is fed into the pressing nip between the image carrier and the transfer member by the recording paper sheet feed device.

7. The method for controlling the power supply for transfer in the image forming device according to claim 1, wherein the output voltage of the power supply for transfer is switched from said effectively 0 V to the high voltage for transfer before the recording paper sheet is fed into the pressing nip between the image carrier and the transfer member by the recording paper sheet feed device.

8. An image forming device comprising:

an image carrier which is rotatable and capable of forming a toner image on a circumferential surface thereof, and is capable of rotating while holding the toner image thereon, a transfer member which is for transferring the toner image on the image carrier onto a recording paper sheet and capable of rotating, provided in a manner capable of pressing against, coming into contact with and retreating from the image carrier, and which forms a pressing nip by being pressed against the image carrier, a power supply for transfer for applying a voltage to the transfer member for transfer for transferring the toner image on the image carrier onto the recording Paper sheet, a recording paper sheet feed device for feeding the recording paper sheet into the pressing nip, and a power supply controller for the power supply for transfer, the power supply for transfer being turned on by a power supply ON instruction signal from the power supply controller, being turned off by a power supply OFF instruction signal from the power supply controller, and using a voltage set by an output voltage setting signal from the power supply controller as an output voltage when the power supply is on, the power supply controller turning on the power supply for transfer and setting the output voltage of the power supply for transfer to effectively 0 V before the transfer member is pressed against the image carrier, and switching the output voltage of the power supply for transfer from effectively 0 V to a high voltage for transfer after the transfer member is pressed against the image carrier, wherein the power supply for transfer comprises a first high voltage generating part which generates a voltage of a first polarity and a second high voltage generating part which generates a high voltage of a second polarity which is different from the first polarity, and both the first high voltage generating part and the second high voltage generating part simultaneously generate the high voltage when the power supply controller turns on the power supply for transfer and sets the output voltage of the power supply for transfer to effectively 0 V.

9. The image forming device according to claim 8, wherein a value of an output voltage of the first high voltage generating part is a fixed value; a value of an output voltage of the second high voltage generating part is variable; and the value of the output voltage of the second high voltage generating part is set by the output voltage setting signal from the power supply controller.

10. The image forming device according to claim 9, wherein the recording paper sheet feed device comprises a recording paper sheet feed part, and a timing roller unit for pausing the recording paper sheet fed from the recording paper sheet feed part short of the pressing nip and feeding the recording paper sheet into the pressing nip at a timing when the toner image on the image carrier which reaches the pressing nip can be transferred onto the recording paper sheet; the distance from the position of the front end of the recording paper sheet which is paused by the timing roller unit to the pressing nip between the image carrier and the transfer member is shorter than a predetermined distance; and the predetermined distance is such that in forming the toner image on the image carrier and transferring the toner image onto the recording paper sheet, when the power supply controller turns on the power supply for transfer and the output voltage of the power supply is set to the high voltage for transfer after the transfer member is pressed against the image carrier, the paused recording paper sheet starts to be fed into the pressing nip by the timing roller unit in a period of time shorter than that required for a voltage applied to the transfer member to rise to the set high voltage for transfer.

11. The image forming device according to claim 9, wherein the first polarity is negative, and the second polarity is positive.

12. The image forming device according claim 11, wherein the power supply controller switches the output voltage of the power supply for transfer from said effectively 0 V to the high voltage for transfer before the recording paper sheet is fed into the pressing nip between the image carrier and the transfer member by the recording paper sheet feed device.

13. The image forming device according claim 9, wherein the power supply controller switches the output voltage of the power supply for transfer from said effectively 0 V to the high voltage for transfer before the recording paper sheet is fed into the pressing nip between the image carrier and the transfer member by the recording paper sheet feed device.

14. The image forming device according to claim 8, wherein the power supply controller switches the output voltage of the power supply for transfer from said effectively 0 V to the high voltage for transfer before the recording paper sheet is fed into the pressing nip between the image carrier and the transfer member by the recording paper sheet feed device.

15. The image forming device according claim 8, wherein the power supply controller switches the output voltage of the power supply for transfer from said effectively 0 V to the high voltage for transfer before the recording paper sheet is fed into the pressing nip between the image carrier and the transfer member by the recording paper sheet feed device.

* * * * *